US009193500B2

(12) United States Patent
Lu

(10) Patent No.: US 9,193,500 B2
(45) Date of Patent: Nov. 24, 2015

(54) METHOD OF FOLDING PALLET SUPPORTS

(75) Inventor: Shang-Wen Lu, Taipei (TW)

(73) Assignee: AIRBAG PACKING CO., LTD., New Taipei (TW)

( * ) Notice: Subject to any disclaimer, the term of this patent is extended or adjusted under 35 U.S.C. 154(b) by 611 days.

(21) Appl. No.: 13/581,713

(22) PCT Filed: Apr. 13, 2011

(86) PCT No.: PCT/CN2011/000651

§ 371 (c)(1),
(2), (4) Date: Aug. 29, 2012

(87) PCT Pub. No.: WO2012/037766

PCT Pub. Date: Mar. 29, 2012

(65) Prior Publication Data

US 2012/0322642 A1 Dec. 20, 2012

(30) Foreign Application Priority Data

Sep. 21, 2010 (WO) ..... PCT/CN2010/001455

(51) Int. Cl.
*B31B 1/26* (2006.01)
*B65D 19/00* (2006.01)

(52) U.S. Cl.
CPC .. *B65D 19/0095* (2013.01); *B65D 2519/00019* (2013.01); *B65D 2519/00034* (2013.01); *B65D 2519/00054* (2013.01); *B65D 2519/00069* (2013.01); *B65D 2519/00273* (2013.01); *B65D 2519/00293* (2013.01); *B65D 2519/00323* (2013.01); *B65D 2519/00333* (2013.01); *B65D 2519/00402* (2013.01); *B65D 2519/00567* (2013.01)

(58) Field of Classification Search
CPC ..... B65D 19/0004; B65D 19/32; B65D 19/00034; B65D 19/38; B65D 19/18; B65D 2519/00019; B65D 2519/00054; B65D 2519/00323; B65D 2519/00402; B65D 2519/00273; B65D 19/0095; B65D 2519/00333; B65D 19/40; B65D 2519/00373
USPC ..... 493/405; 108/51.3, 57.18, 57.19, 57.29, 108/157.14; 206/6.1, 120.26, 596, 598, 206/599, 600
See application file for complete search history.

(56) References Cited

U.S. PATENT DOCUMENTS 5,184,558 A * 2/1993 Wozniacki ..... 108/51.3
7,475,639 B2 * 1/2009 Chen ..... 108/51.3

* cited by examiner

*Primary Examiner* — Thanh Truong
*Assistant Examiner* — Xavier A Madison
(74) *Attorney, Agent, or Firm* — Ching-Mung Shih

(57) ABSTRACT

In a method of folding a pallet support integrally formed by folding a board material, both sides of the board material are pressed and folded inwardly for at least two times; a center-line of the board material is used as a reference to fold the whole piece of the board material in half; the board material is pressed flatly; an upper end of the board material is bent towards both sides of the board material to a predetermined length to form the pallet support with a cross-section having a thickness of a plurality of layers of the board material; and an upper end of the board material is folded towards both sides to form the pallet support of a T-shape cross-sectional structure with a thickened bottom and a cross-section with a thickness of a plurality of layers of the board material.

12 Claims, 14 Drawing Sheets

METHOD OF FOLDING PALLET SUPPORTS

BACKGROUND OF THE INVENTION

1. Field of the Invention

The present invention relates to a method of folding pallet supports, and more particularly to the method of forming pallet supports of a pallet with the features of a simple structure, a low cost, an easy assembling process, a strong strength and a large bearing capacity.

2. Description of Related Art

In general, pallets are made of wood, plastic or metal, but wooden pallets deteriorate naturally after a long time of use and have the issue of quarantine pests and diseases, and plastic pallets manufactured by injection molding require a mold and incur a higher manufacturing cost. In addition, the plastic pallets may be cracked or broken easily when carrying heavy loads and create an environmental protection problem since plastic cannot be degenerated easily. Although metal pallets have a secured solid structure capable of carrying goods of a heavy load, the metal pallets are expensive, heavy, and inconvenient for both storage and transportation. Therefore, paper pallets become a popular trend for carrying and transporting goods, and related designers and manufacturers design and develop various different paper pallet structures.

In general, a paper pallet support is made of a cardboard material and formed by folding a cardboard integrally. In the method of folding the paper pallet support, both sides of the cardboard material are folded toward the center of the cardboard material, and the centerline of the cardboard material is used as a reference to fold the whole piece of cardboard material in half. Now, an end of the cardboard is bent towards both sides to form a T-shape cross-sectional structure with a thickened top, so as to provide a stable supporting structure.

Although the conventional method of folding paper pallet supports can fold a paper pallet support by using a single cardboard to save the adhesion process, the folding method simply folds the single cardboard into a support 5 of a T-shape cross-sectional structure with a thickened top as shown in FIG. 2, and cannot be folded into an I-shape cross-sectional structure with thickened top and bottom. Obviously, the strength at the thickened portion of the top 51 of the T-shape cross-sectional structure is sufficient, but the strength at the bottom 52 is insufficient. Therefore, the height of insert slots 521 formed at the bottom 52 and provided for inserting forklift arms of a forklift into the insert slots 521 respectively cannot be designed to meet the requirement due to the insufficient strength of the bottom 52. If the pallet is assembled into a meshed paper pallet, the two forklift arms may collide with sidewalls 522 of the bottom 52 easily since the height of the insert slots 521 at the bottom 52 is insufficient for passing the forklift arms. As a result, the sidewalls 522 are damaged and the whole pallet cannot be used anymore. In the conventional method of folding paper pallet supports, both sides of the cardboard material are folded towards the center of the cardboard material, so that the center of the bottom of the cardboard only has the downwardly folded portion with a single-side support to the cardboard, and the support is insufficient to carry a heaver load, and the pallet support may be deformed easily by heavy loads. Obviously, the prior art has the aforementioned drawbacks and requires improvements.

SUMMARY OF THE INVENTION

Therefore, it is a primary objective of the present invention to provide a method of folding a pallet support. With this special folding method, the pallet has a higher loading capacity to transport heavier goods and enhance the practicality of the pallet.

Another objective of the present invention is to provide a method of folding a pallet support, wherein a single board is used to form the pallet support integrally without requiring any adhesion in the manufacturing process, so that the loading capacity of the pallet can be increased significantly without incurring additional cost.

A further objective of the present invention is to provide a method of folding a pallet support, wherein a single board is used to integrally form the pallet support which is an I-shape cross-sectional structure with thickened top and bottom, so that the top and the bottom of the pallet support can provide larger strength and better support.

To achieve the aforementioned and other objectives, the method of folding pallet supports of the present invention comprises a board formed by folding a board material integrally, and the method comprises the steps of: pressing and folding both sides of the board material inwardly for at least two times; using a centerline of the board material as a reference to fold the whole piece of the board material in half; pressing the board material flatly; and bending an upper end of the board material towards both sides of the board material to a predetermined length to form the pallet support with a cross-section having a thickness of a plurality of layers of the board material, and folding an end of the board material towards both sides to form an I-shape cross-sectional structure with thickened top and bottom, so that the pallet support enhances the strength at both upper and lower ends of the pallet support to provide a stable supporting function.

BRIEF DESCRIPTION OF THE DRAWINGS

The invention, as well as its many advantages, may be further understood by the following detailed description and drawings in which.

DETAILED DESCRIPTION OF THE INVENTION

Figure 1:
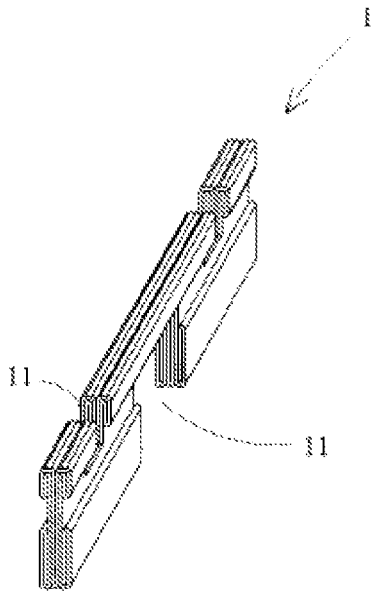
FIG. 1 is a schematic view of the structure of a support of the present invention.
Figure 2:
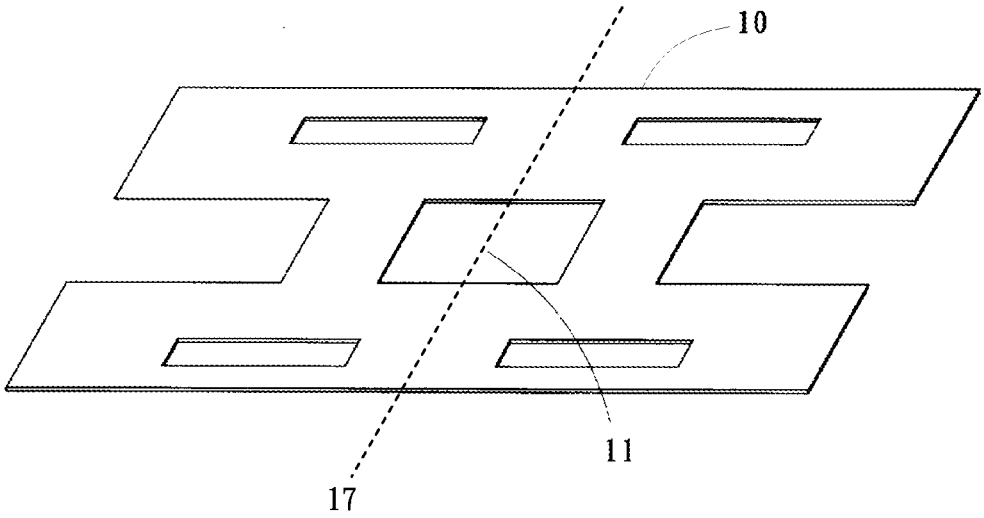
FIGS. 2 to 10 are schematic views showing a series of continuous folding actions of a support in accordance with the present invention.
Figure 3:
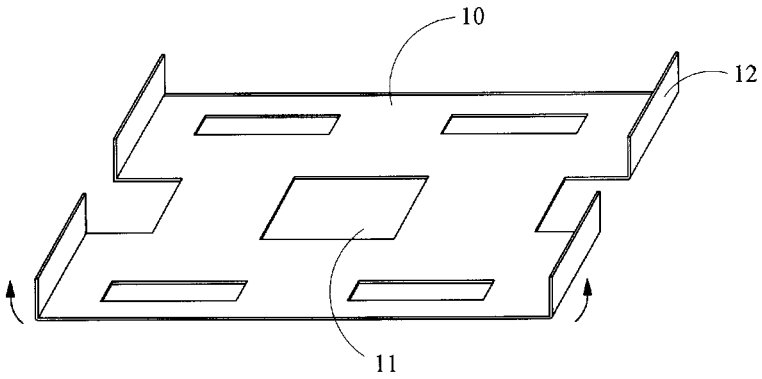
Figure 4:
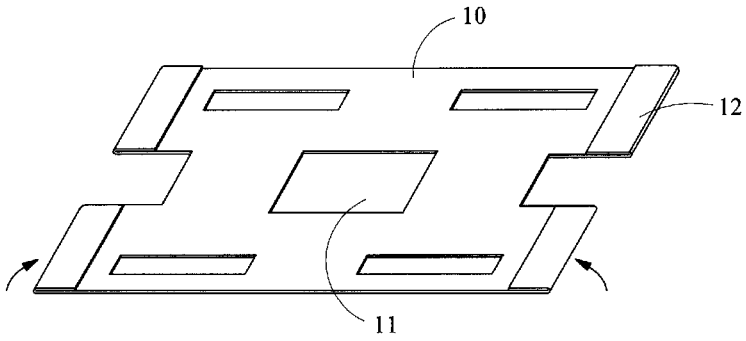
Figure 5:
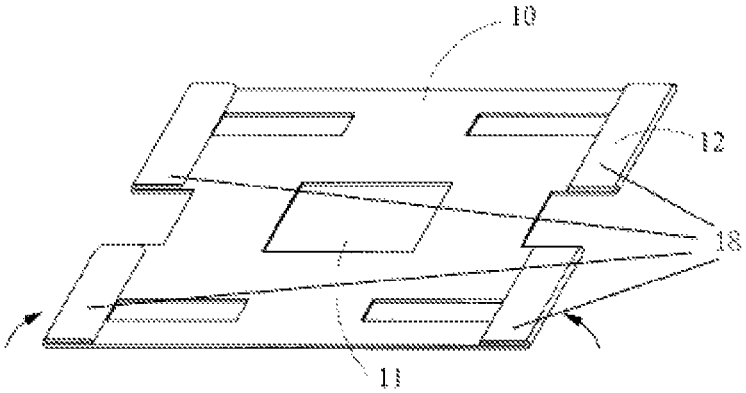
Figure 6:
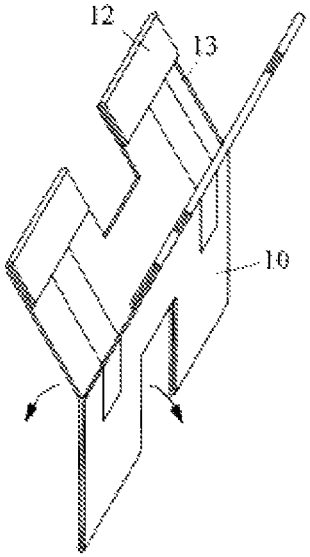
Figure 7:
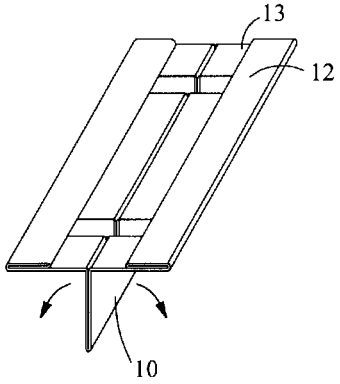
Figure 8:
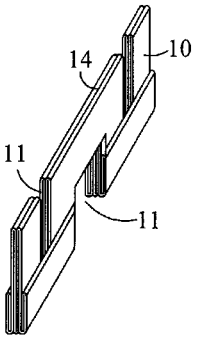

With reference to FIG. 1 for a pallet support 1 manufactured by a method of folding pallet supports of the present invention, a pallet is formed by folding a board material 10 into a T-shape cross-sectional structure with a thickened bottom or an I-shape cross-sectional structure with thickened top and bottom, and a notch 11 is reserved for assembling the pallet or enhancing the strength. The notch 11 required by the pallet support 1 is pre-cut from the board material and then formed by folding.

FIGS. 2 to 8, the pallet support 1 is formed folding a board material 10 integrally, wherein both sides 12 of the board material 10 are pressed and folded inwardly for at least two times to form two folded parts 18 on both sides of the board material respectively. The two folded parts 18 are spaced apart from each other, and then a centerline 17 of the board material 10 is used as a reference to fold the whole piece of the board material 10 in half. After the board material 10 is pressed flatly, an upper end 13 of the board material 10 is folded towards both sides with a predetermined length (which is equal to one-half of the length of the board material 10 in this preferred embodiment) to form a pallet support having a cross-section equal to the thickness of a plurality of layers of the board material and a T-shape cross-sectional structure with a thickened bottom.

Figure 9:
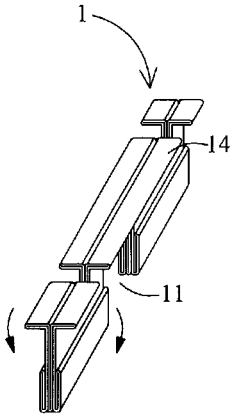
Figure 10:
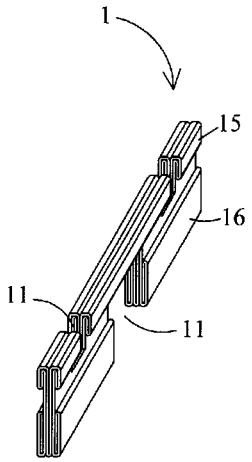

In FIGS. 9 and 10, a top end 14 of the pallet support of the T-shape cross-sectional structure is further folded towards both sides to form a pallet support 1 of an I-shape cross-sectional structure with thickened top 15 and bottom 16 to enhance the strength at upper and lower ends to provide a stable supporting function.

With the aforementioned folding method, the manufacturing simply requires one cutting process of the board material and five folding processes to form the structure of the pallet support 1, so as to achieve the effects of simple manufacture and low cost.

Figure 11:
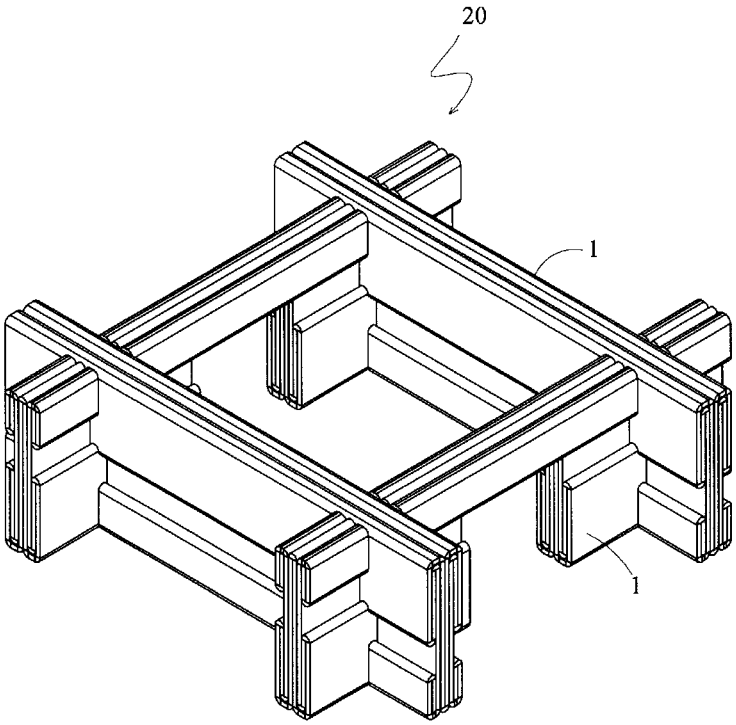
FIGS. 11 and 21 are schematic views showing the structure of a supporting base of the present invention.
Figure 12:
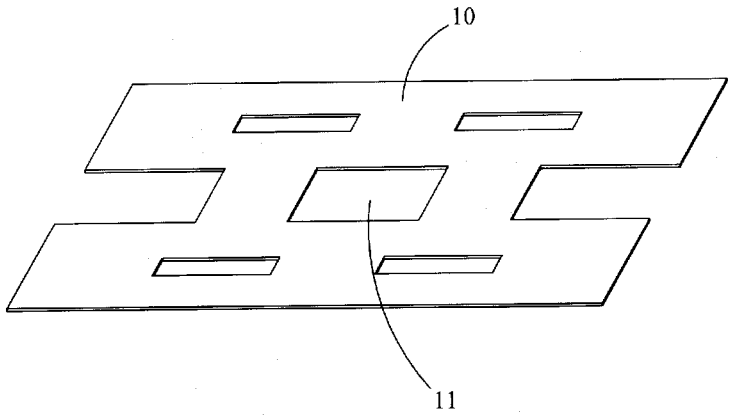
FIGS. 12 to 20 are schematic views showing another series of continuous folding action of a support in accordance with the present invention.
Figure 13:
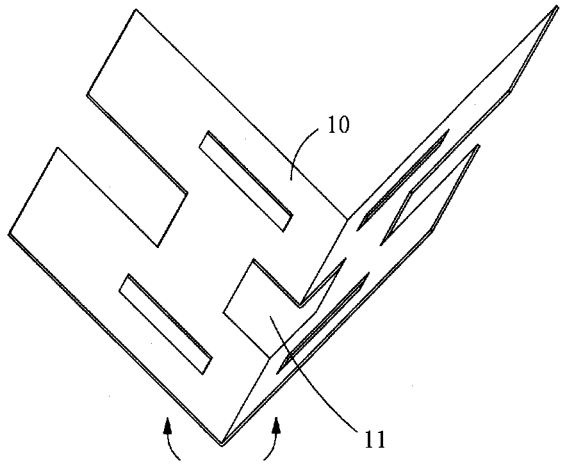
Figure 14:
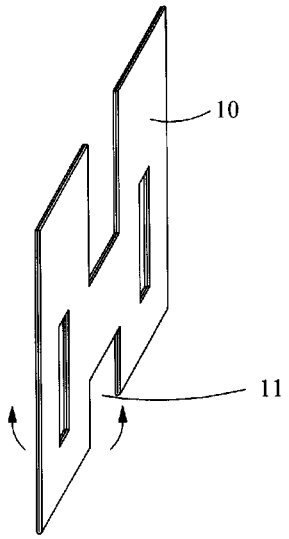
Figure 15:
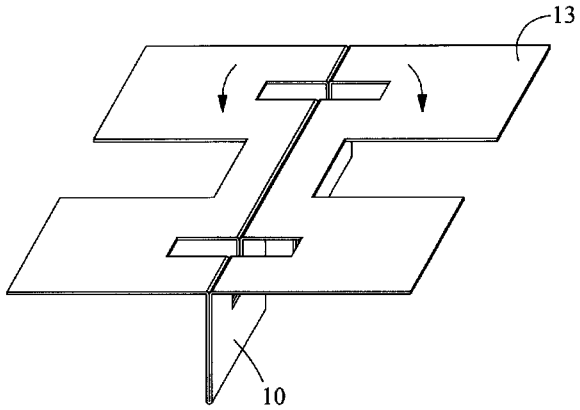
Figure 16:
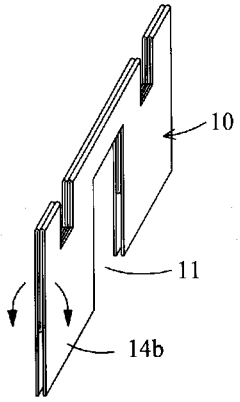
Figure 17:
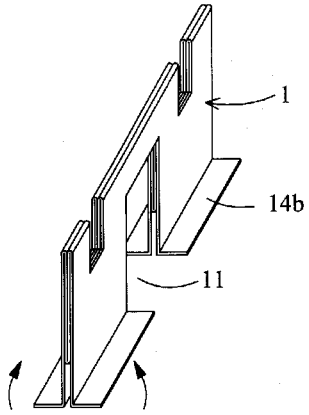
Figure 21:
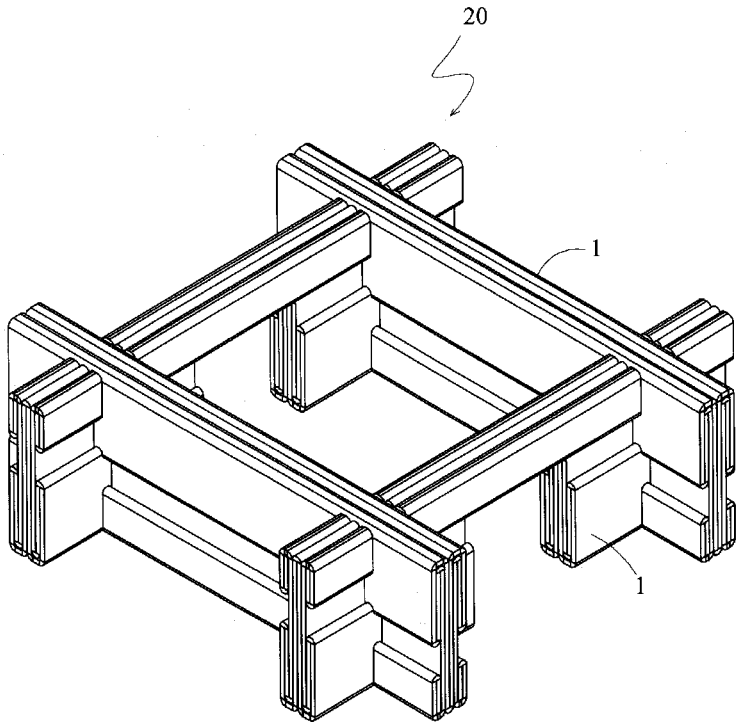
Figure 22:
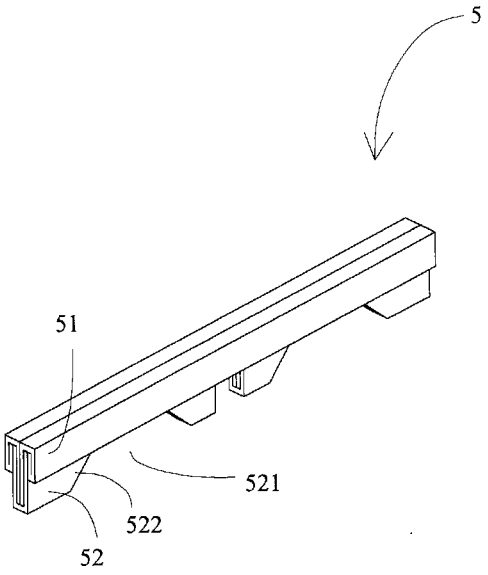
FIG. 22 is a schematic view of a conventional paper pallet support.
Figure 23A:
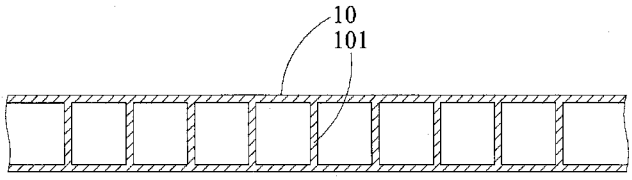
FIGS. 23A, 23B, 23C and 23D are cross-sectional views of a board material of the present invention board material.
Figure 23B:
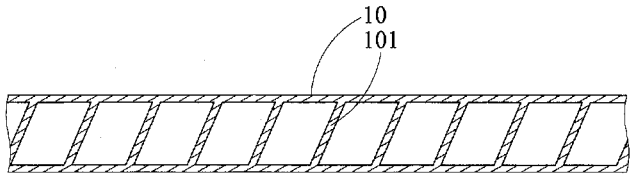
Figure 23C:
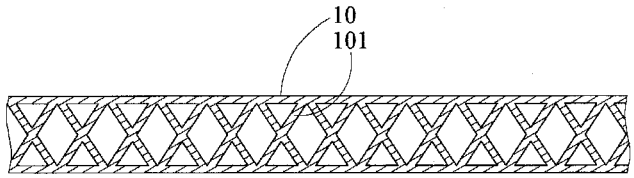
Figure 23D:
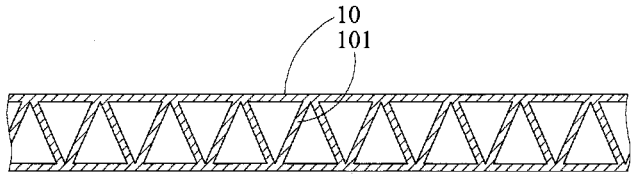

In FIGS. 11 and 21, the pallet supports 1 can be combined with one another to form a meshed pallet supporting base 20. Since the pallet support 1 is thickened to provide a larger supporting force, and the pallet support 1 is an I-shape cross-sectional structure with thickened top 15 and bottom 16, therefore the top 15 and the bottom 16 have the function of enhancing the strength.

In FIG. 1, the board material 10 is a cardboard material such as a paper corrugated board or a plastic board material such as a polypropylene (PP) corrugated board or a polycarbonate (PC) corrugated board.

In FIGS. 23A, 23B, 23C and 23D, the board material 10 has a plurality of reinforcing ribs 101 disposed on a cross-section of the board material 10, and the reinforcing ribs 101 can be a longitudinal reinforcing rib, an oblique reinforcing rib, a cross reinforcing rib, or a V-shape reinforcing rib.

With reference to FIGS. 12 to 18 for another folding method of the present invention, the board material 10 is folded in half, and then an upper end 13 of the board material 10 is bent towards both sides with a predetermined length (such as one-half of the length of the board material 10) to form a cross-section with a thickness equal to a plurality of layers of the board material 10, and then a lower end 14*b* of the board material is pressed and folded outwardly for at least two times to form a pallet support of the T-shape cross-sectional structure with a thickened bottom 16.

Figure 19:
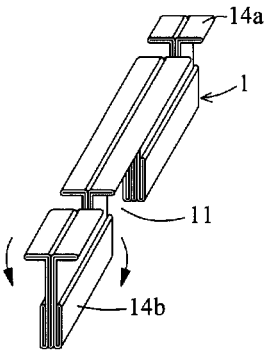
Figure 20:
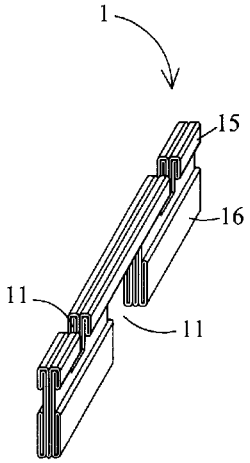

In FIGS. 19 and 20, an upper end 14*a* of the pallet support of the T-shape cross-sectional structure is further pressed and folded outwardly to form a pallet support 1 of the I-shape cross-sectional structure with thickened top 15 and bottom 16, so as to provide more choices for the manufacturing method.

Figure 18:
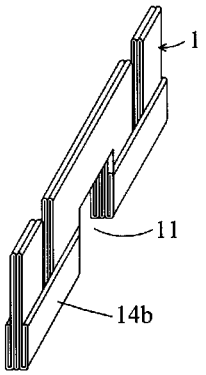

In FIG. 18, the board material 10 is a cardboard material such as a paper corrugated board or a plastic board material such as a polypropylene (PP) corrugated board or a polycarbonate (PC) corrugated board.

In FIGS. 23A, 23B, 23C and 23D, the board material 10 has a plurality of reinforcing ribs 101 disposed on a cross-section of the board material 10, and the reinforcing ribs 101 can be a longitudinal reinforcing rib, an oblique reinforcing rib, a cross reinforcing rib, or a V-shape reinforcing rib.

In addition, the pallet support 1 of the present invention can be folded into a T-shape cross-sectional structure or an I-shape cross-sectional structure according to the required supporting force. For a smaller required supporting force, the T-shape cross-sectional structure is adopted; and for a larger required supporting force, the I-shape cross-sectional structure is adopted. The length of the board material 10 required for folding the T-shape cross-sectional structure is smaller than that for folding the I-shape cross-sectional structure, so that approximately 3% of the cost can be saved.

The height of the thickened portion of the top 15 of the pallet support 1 can be adjusted freely, so that the pallet supports 1 can be embedded and connected with one another to form a pallet supporting base 20 whose top has different strengths, wherein the thickened portion can be increased by preparing a longer board material 10, and then pressing and folding the upper end 14*a* of the longer board material 10 outwardly when the top 15 is folded; and the thickened portion can be decreased by preparing a shorter board material 10, and then pressing and folding the upper end 14*a* of the shorter board material 10 outwardly when the top 15 is folded.

The height of the thickened portion of the bottom 16 of the pallet support 1 can be adjusted freely, so that the pallet supports 1 can be embedded and connected with one another to form a pallet supporting base 20 whose top has different strengths, wherein the thickened portion can be increased by preparing a longer board material 10, and then pressing and folding the lower end 14*b* of the longer board material 10 outwardly when the bottom 16 is folded; and the thickened portion can be decreased by preparing a shorter board material 10, and then pressing and folding the lower end 14*b* of the shorter board material 10 outwardly when the bottom 16 is folded.

In a preferred embodiment of the present invention, thickened portion of the bottom 16 of the pallet support 1 is adjusted to one-half of the height of the support 1 to achieve the greatest strength with a minimum use of the board material.

When the pallet support 1 of the present invention is assembled to the pallet supporting base 20, the thickened portion of the bottom 16 of the pallet support 1 enhances the strength of the bottom 16, so that even if the two forklift arms of the forklift are passed into the two insert slots formed at the bottom of the supporting base 20 to lift the supporting base 20 and the sidewalls of the two insert slots formed at the bottom of the supporting base 20 are collided by the two forklift arms of the forklift, the pallet support 1 and the supporting base 20 will not be deformed easily.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A method of folding a pallet support, integrally made of a board material, comprising the steps of:

pressing and folding both exterior surfaces of the board material inwardly towards a centerline of the board material for at least two times to form two folded parts on both entire sides of the board material respectively, wherein the two folded parts are spaced apart from each other;

using the centerline of the board material as a reference to fold the whole piece of the board material in half;

pressing the board material flatly;

bending an upper end of the board material towards both exterior surfaces of the board material to a predetermined length to form the pallet support with a cross-section having a thickness of a plurality of layers of the board material and a bottom of the pallet support being a thickened T-shape cross-sectional structure; and bending a top end of the pallet support of the T-shape cross-sectional structure towards both exterior surfaces to form a pallet support of an I-shaped cross-sectional structure with thickened top and bottom, wherein the thickened top and bottom have at least eight layers of board material respectively.

2. The method of folding a pallet support as recited in claim 1, wherein the pallet support has a notch pre-cut from the board material and then formed by folding.

3. The method of folding a pallet support as recited in claim 1, wherein the board material is one selected from a collection of a cardboard material and a plastic board material.

4. The method of folding a pallet support as recited in claim 3, wherein the cardboard material is a paper corrugated board.

5. The method of folding a pallet support as recited in claim 3, wherein the plastic board material is one selected from the collection of a PP corrugated board and a PC corrugated board.

6. The method of folding a pallet support as recited in claim 3, wherein the board material has a plurality of reinforcing ribs disposed on a cross-section of the board material.

7. A method of folding a pallet support, integrally made of a board material, comprising the steps of:

folding the board material in half;

bending an upper end of the board material towards both exterior surfaces of the board material to a predetermined length to form the pallet support with a cross-section having a thickness of a plurality of layers of the board material;

pressing and folding a lower end of the board material outwardly for at least two times to form the pallet support of a T-shape cross-sectional structure with a thickened bottom; and bending a top end of the pallet support of the T-shape cross-sectional structure towards both exterior surfaces to form a pallet support of an I-shaped cross-sectional structure with thickened top and bottom, wherein the thickened top and bottom have at least eight layers of board material respectively.

8. The method of folding a pallet support as recited in claim 7, wherein the pallet support has a notch pre-cut from the board material and then formed by folding.

9. The method of folding a pallet support as recited in claim 7, wherein the board material is one selected from the collection of a cardboard material and a plastic board material.

10. The method of folding a pallet support as recited in claim 9, wherein the cardboard material is a paper corrugated board.

11. The method of folding a pallet support as recited in claim 9, wherein the plastic board material is one selected from the collection of a PP corrugated board and a PC corrugated board.

12. The method of folding a pallet support as recited in claim 9, wherein the board material has a plurality of reinforcing ribs disposed on a cross-section of the board material.

* * * * *